US008496506B2

(12) United States Patent
Wenzel

(10) Patent No.: US 8,496,506 B2
(45) Date of Patent: Jul. 30, 2013

(54) BREASTSTROKE SWIMMING TRAINING PADDLES WITH FINS

(76) Inventor: Drew H. Wenzel, Fremont, CA (US)

( * ) Notice: Subject to any disclaimer, the term of this patent is extended or adjusted under 35 U.S.C. 154(b) by 139 days.

(21) Appl. No.: 12/986,536

(22) Filed: Jan. 7, 2011

(65) Prior Publication Data

US 2011/0165804 A1 Jul. 7, 2011

Related U.S. Application Data

(60) Provisional application No. 61/292,965, filed on Jan. 7, 2010.

(51) Int. Cl.
*A63B 31/10* (2006.01)

(52) U.S. Cl.
USPC ..... 441/58; 441/56; 441/57

(58) Field of Classification Search
USPC ..... 441/56, 57, 58; D21/807
See application file for complete search history.

(56) References Cited

U.S. PATENT DOCUMENTS

| | | | | |
|---|---|---|---|---|
| 2,159,972 | A | 9/1938 | Larson | |
| 2,211,536 | A * | 8/1940 | Clayton, Jr. | 441/57 |
| 3,286,287 | A | 11/1966 | Martin | |
| 3,765,042 | A * | 10/1973 | Montrella | 441/58 |
| 4,913,418 | A | 4/1990 | Schlueter et al. | |
| 5,376,036 | A * | 12/1994 | Hull | 441/58 |
| D363,754 | S | 10/1995 | Johnson | |
| 5,511,998 | A * | 4/1996 | Johnson | 441/56 |
| 6,743,023 | B2 | 6/2004 | Topolski | |
| 7,361,070 | B2 | 4/2008 | Bolstor | |

* cited by examiner

*Primary Examiner* — Lars A Olson
(74) *Attorney, Agent, or Firm* — Cesari and McKenna, LLP

(57) ABSTRACT

A training paddle for use by a swimmer comprises a base configured to accommodate a hand of the swimmer. A strap holds the base to the hand. A raised fin that extends upward from the base directs water away from flowing between the hand and the base.

20 Claims, 5 Drawing Sheets

BREASTSTROKE SWIMMING TRAINING PADDLES WITH FINS

RELATED APPLICATIONS

The present application claims priority to U.S. Provisional Patent Application No. 61/292,965 filed on Jan. 7, 2010, entitled "Breaststroke Swimming Training Paddles With Fins", the contents of which are incorporated by reference herein in their entirety.

BACKGROUND OF THE INVENTION

1. Field of the Invention

The present invention relates generally to a training device, and, more particularly, to a swimming training paddle.

2. Background Information

Swimmer training paddles, which attach to a swimmer's hands to provide desired resistance and enhancement to stroke work, are well known. The paddles are generally used to work on stroke technique, upper-body isolation training, stroke balance and so forth. The paddles typically perform well when the fluid environment (water and air) through which the paddles move produces a strong force normal to the plane of the palm throughout the entire stroke. An example of such a stroke is the front crawl (more commonly known as freestyle), in which the arms move along the long axis of the body to provide propulsion; this is the same as the forward motion of the swimmer's body through the water. The known prior training paddles do not, however, work well for strokes that incorporate a sideways motion of the arms (along the short axis of the body) to propel the body forward through the water. In particular, the known prior training paddles do not work well for the breaststroke.

The known prior training paddles are essentially flat, rest against the palm of the hand and attach to the hand and/or wrist with straps. During the freestyle stroke, the movement of the paddle in the direction of the long axis of the stroke essentially holds the paddle against the swimmer's hand. In strokes like the breaststroke, however, in which the long axis of the stroke is perpendicular to the arms' movement through the water, water is forced between the surface of the paddle and the swimmer's hand. This results in a loosening of the straps holding the respective training paddles to the hands, and thus, a loss of efficiency in training. Eventually, the straps may loosen enough that the force of the water causes the paddle to actually separate from the hand, and thus, become essentially useless as a training tool. To avoid the loosening of the straps and/or the loss of the paddles, breaststrokers are generally required to swim more slowly, and the training is thus adversely affected.

SUMMARY OF THE INVENTION

The present invention overcomes the disadvantages of the prior art by providing a training paddle, designed for use with the breaststroke and/or other strokes in which the swimmer's arms move along the short-axis of the body (perpendicular to the long axis and the motion of the swimmer through the water). According to an illustrative embodiment, the paddle comprises a base that is shaped to conform to the swimmer's hand, and a raised fin that extends around the perimeter of the base. One or more stretchable straps hold the paddles in place on the hands. The fin, which is illustratively dimensioned to fit over the ends of the swimmer's fingers and thumb, directs water over and around the swimmer's hand. Accordingly, water is not forced between the palm and the surface of the base of the paddle during, for example, the short-axis motion of the breaststroke. The paddle may further include through-holes, strategically arranged to promote aerodynamics as well as to minimize the weight of the paddle.

BRIEF DESCRIPTION OF THE DRAWINGS

The above and further advantages of the invention may be better understood by referring to the following description in conjunction with the accompanying drawings in which like reference numerals indicate identically or functionally similar elements, of which.

DETAILED DESCRIPTION OF ILLUSTRATIVE EMBODIMENTS

Figure 1:
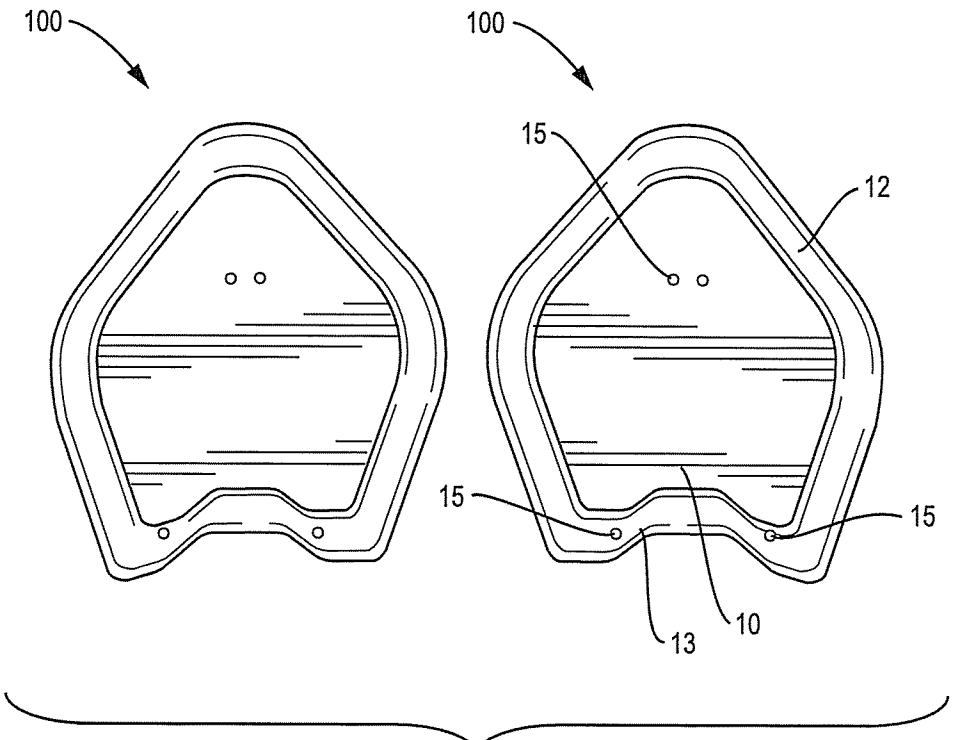
FIG. 1 depicts an exemplary training paddle constructed in accordance with an embodiment of the present invention.
Figure 2A:
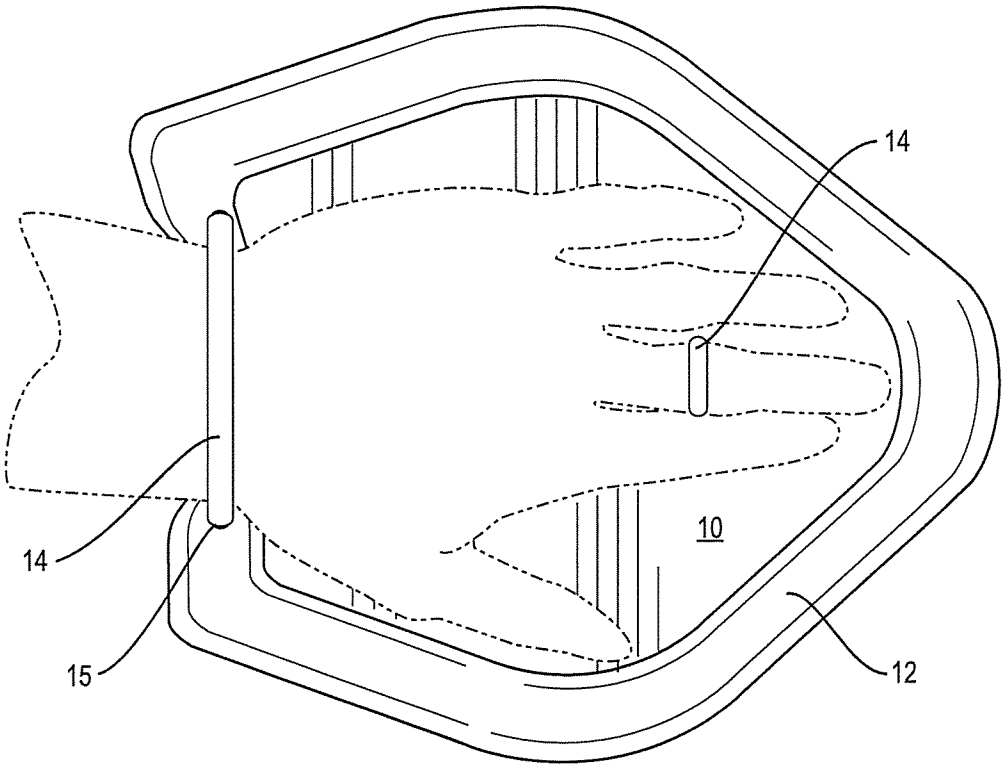
FIGS. 2A-C depict the training paddle of FIG. 1 in place on a user's hand.
Figure 2B:
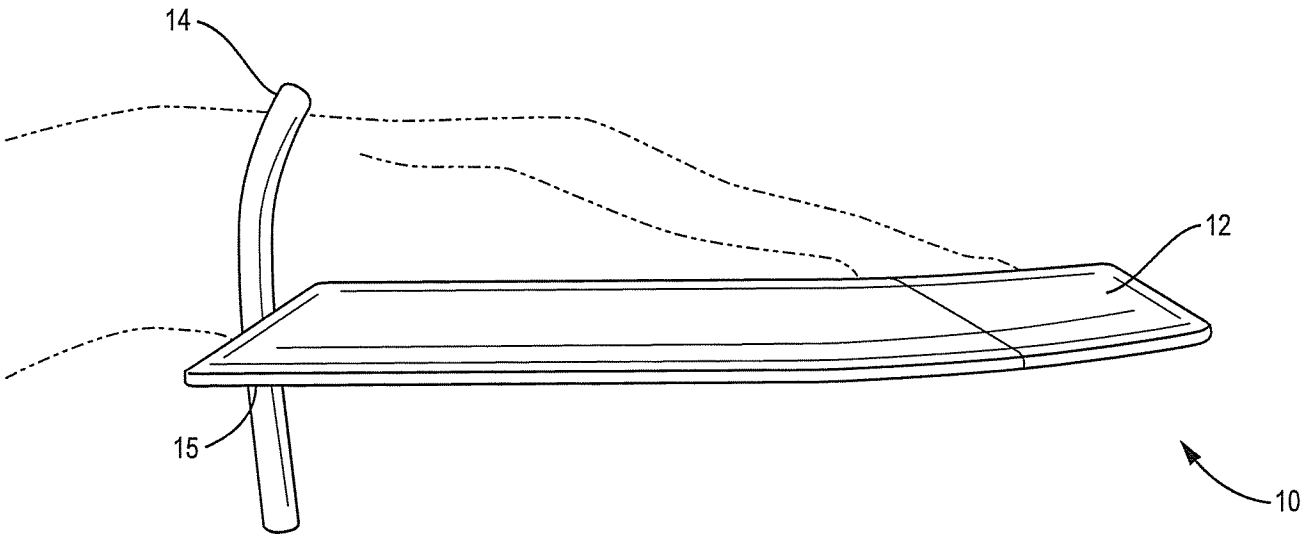
Figure 2C:
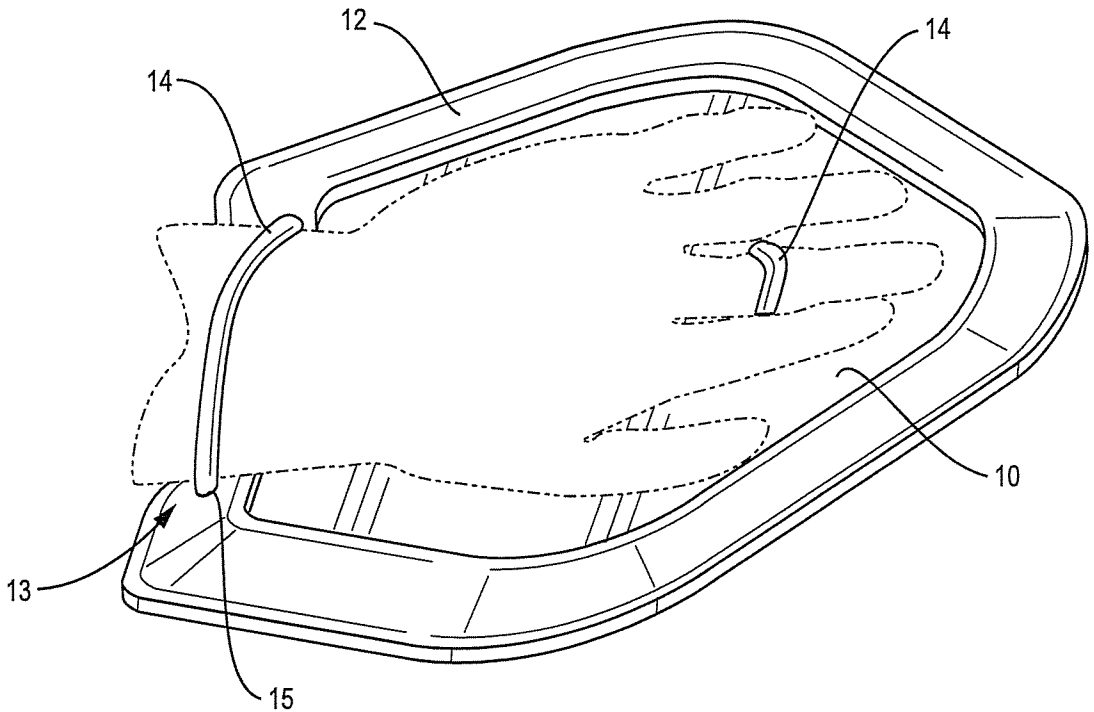

Referring to FIGS. 1 and 2A-C, a training paddle 100 includes a base 10 that is shaped to accommodate a hand. An indent 13 leaves the wrist free to bend and rotate. A raised fin 12 extends around the perimeter of the base and is dimensioned to fit over the tips of a user's fingers and thumb when the user's hand is in place on the paddle. One or more, e.g., rubber, straps 14 fit into holes 15 in the base 10, and operate to hold the paddle in place on the user's hand. As shown, the straps 14 fit over a user's wrist and finger(s), and extend through holes 15 to hold the hand to the base.

The fin 12 essentially fits over the ends of the user's fingers and thumb, and directs water over and around the user's hand when the user is moving his/her arm in a direction that is illustratively perpendicular to the direction of motion of his/her body through the water. Accordingly, during a breaststroke, for example, water is directed away from flowing between the user's hand and the base 10. Thus, any water that does flow between the user's hand and the base 10 does not do so with a force that is sufficient to loosen the straps 14 and/or cause a separation between the hand and the base 10.

The paddle 100 may further include holes that are placed to increase the aerodynamics of the paddle while also reducing the weight of the paddle.

Figure 3:
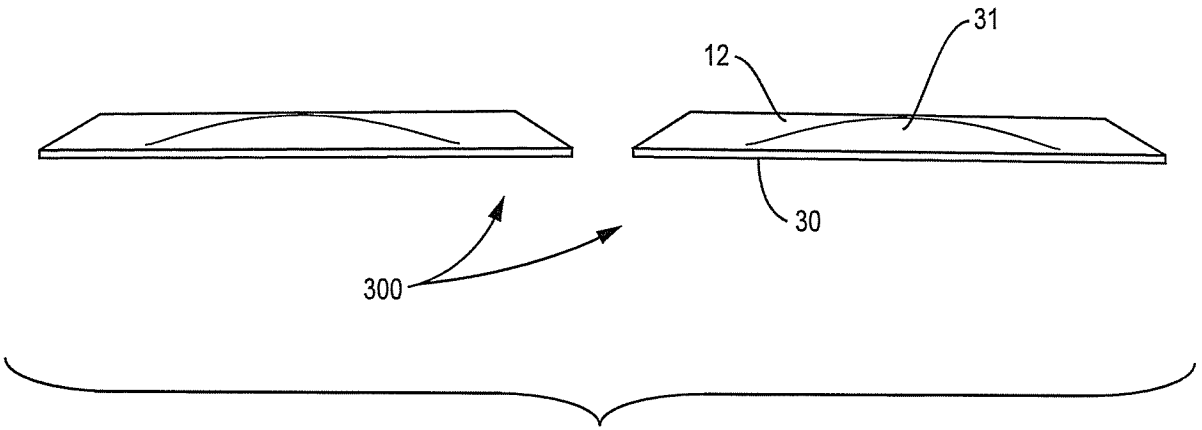
FIG. 3 depicts an exemplary alternative embodiment of the paddle of FIG. 1.

FIG. 3 depicts an alternative embodiment 300 of the paddle. In the cross section view, the base 30 has a raised and sloped center section 31. The center section is designed to conform to the palm of a hand that is relaxed or may be even slightly cupped.

Referring again to FIGS. 2A-B, which depict the paddle in place on a user's hand, the fin 12 may be arranged such that the fin essentially extends over tips of the user's fingers and thumb. In use, the fin 12 illustratively directs water over and around the user's hand when the motion of the swimming stroke is perpendicular to the motion of the swimmer through the water. Notably, the base 10 is shaped to the outer dimensions of the user's hand, and the concave indent 13 leaves the user's wrist free to bend and rotate.

The foregoing description has been directed to specific embodiments of this invention. It will be apparent, however, that other variations and modifications may be made to the described embodiments, with the attainment of some or all of their advantages. For instance, it is expressly contemplated that the paddle may include alternative attachment mechanisms for one of the end straps, such as screws, tacks, or other known mechanisms, or a combination thereof. Also, the straps are illustratively described as being made of rubber, however, the straps may instead consist of other known stretchable materials. As such, the use of a rubber strap should be taken as exemplary only. Furthermore, the paddle may, but need not be, custom sized and shaped to a given user's hand. Moreover, additional holes may be included to receive the straps, and to accommodate different sizes of wrists and fingers. Accordingly, this description is to be taken only by way of example and not to otherwise limit the scope of the invention. Therefore, it is the object of the appended claims to cover all such variations and modifications as come within the true spirit and scope of the invention.

What is claimed is:

1. An apparatus for use by a swimmer, comprising: a base having an exterior surface and configured to accommodate a hand of the swimmer; a strap configured to hold the base to the hand; and a raised fin having a portion that is at a higher point than the exterior surface of the base and configured to extend up from the base and around a perimeter of the base, the raised fin further configured to direct water away from flowing between the hand and the base.

2. The apparatus of claim 1, wherein the raised fin is further configured to fit over a portion of the hand.

3. The apparatus of claim 1, wherein the raised fin is further configured to fit over a finger of the hand.

4. The apparatus of claim 1, further comprising a section of the base configured to conform to a palm of the hand.

5. The apparatus of claim 4, wherein the section of the base comprises a raised center section.

6. The apparatus of claim 1, wherein the strap comprises rubber.

7. The apparatus of claim 1, further comprising one or more holes.

8. The apparatus of claim 1, wherein a portion of the base is concave.

9. The apparatus of claim 1, wherein the base conforms to a dimension of the hand.

10. An apparatus for use by a swimmer for breaststroke training, comprising: a base having an exterior surface and configured to accommodate a hand of the swimmer; means for holding the base to the hand; and means for directing water away from flowing between the hand and the base when a first motion of the hand that is held at the base is perpendicular to a second motion of the swimmer, wherein the means for directing comprises an upward extension having a portion that is at a higher point than the exterior surface of the base and extending around a perimeter of the base.

11. The apparatus of claim 10, wherein the means for directing is coupled to the base.

12. The apparatus of claim 10, wherein the means for directing further comprises means for fitting over a portion of the hand.

13. The apparatus of claim 10, wherein the means for directing further comprises means for fitting over a finger of the hand.

14. The apparatus of claim 10, further comprising a section of the base configured to conform to a palm of the hand.

15. The apparatus of claim 14, wherein the section of the base comprises a raised center section.

16. The apparatus of claim 10, wherein the means for holding comprises a strap.

17. The apparatus of claim 10, wherein the base comprises one or more holes.

18. The apparatus of claim 10, wherein a portion of the base is concave.

19. An apparatus for use by a swimmer, comprising: a base having an exterior surface and configured to accommodate a hand of the swimmer; a strap configured to hold the base to the hand; a raised portion of the base configured to fit over and around at least a portion of the hand, and a raised fin having a portion that is at a higher point than the exterior surface of the base and further extending around a perimeter of the base and configured to direct water over the hand.

20. The apparatus of claim 1, wherein the raised fin is further configured to rise above fingers of the hand.

* * * * *

UNITED STATES PATENT AND TRADEMARK OFFICE

CERTIFICATE OF CORRECTION

PATENT NO. : 8,496,506 B2
APPLICATION NO. : 12/986536
DATED : July 30, 2013
INVENTOR(S) : Drew H. Wenzel It is certified that error appears in the above-identified patent and that said Letters Patent is hereby corrected as shown below:

In the Claims

In col. 4, line 31 should read:
the hand; and a raised portion of the base configured to fit over and In col. 4, line 32 should read:
around at least a portion of the hand, ~~and a~~the raised fin having a Signed and Sealed this
Sixth Day of May, 2014

Michelle K. Lee

Michelle K. Lee
*Deputy Director of the United States Patent and Trademark Office*